US006938360B2

(12) United States Patent
Fang et al.

(10) Patent No.: US 6,938,360 B2
(45) Date of Patent: Sep. 6, 2005

(54) ATHLETIC SHOE WITH INFLATABLE TONGUE

(75) Inventors: Roger Hsiao-Ching Fang, Los Angeles, CA (US); Joseph Ho Pin Lin, Taichung South District (TW)

(73) Assignee: ACI International, Los Angeles, CA (US)

( * ) Notice: Subject to any disclaimer, the term of this patent is extended or adjusted under 35 U.S.C. 154(b) by 0 days.

(21) Appl. No.: 10/712,201

(22) Filed: Nov. 12, 2003

(65) Prior Publication Data

US 2005/0097779 A1 May 12, 2005

(51) Int. Cl.[7] ..... A43B 23/26
(52) U.S. Cl. ..... 36/54; 36/93
(58) Field of Search ..... 36/54, 29, 88, 36/93, 71

(56) References Cited

U.S. PATENT DOCUMENTS 3,372,495 A * 3/1968 Finn ..... 36/117.6
3,664,043 A * 5/1972 Polumbus, Jr. ..... 36/71
4,251,932 A * 2/1981 Love ..... 36/7.4
5,113,599 A 5/1992 Cohen et al. ..... 36/88
5,158,767 A 10/1992 Cohen et al. ..... 36/88
5,235,715 A * 8/1993 Donzis ..... 12/142 R
5,351,710 A 10/1994 Phillips ..... 137/223
5,353,525 A * 10/1994 Grim ..... 36/88
5,392,534 A * 2/1995 Grim ..... 36/88
5,406,661 A 4/1995 Pekar ..... 5/454
5,987,779 A 11/1999 Litchfield et al. ..... 36/29
6,505,420 B1 1/2003 Litchfield et al. ..... 36/29

* cited by examiner

*Primary Examiner*—Ted Kavanaugh
(74) *Attorney, Agent, or Firm*—Christopher Darrow; Greenberg Traurig, LLP

(57) ABSTRACT

An athletic shoe having an inflatable tongue which can be slightly deflated or inflated after lacing up or otherwise closing the shoe to conform to the user's foot and the lacing to provide a more comfortable fit of the shoe. The tongue includes an inner bladder of an expandable foam material with a valve on the tongue fluidly communicating the exterior of the tongue with the interior of the bladder to selectively inflate and deflate the same upon introduction and release of air to the bladder.

15 Claims, 4 Drawing Sheets

ATHLETIC SHOE WITH INFLATABLE TONGUE

BACKGROUND OF THE INVENTION

1. Field of the Invention

The invention relates to athletic shoes, and, more particularly, to an athletic shoe having an inflatable tongue for conforming the shoe to the foot of the wearer.

2. Related Art

Athletic shoes having some means for conforming the shoe to the foot of the wearer to make them more comfortable are well known in the art.

An athletic shoe having an inflatable bladder in the form of a tongue is disclosed in U.S. Pat. No. 5,113,599 to Cohen et al. The bladder is inflated by a pump having a release valve. The release valve must be separately activated to deflate the bladder.

In U.S. Pat. No. 5,158,767 to Cohen et al., another athletic shoe with an inflatable tongue bladder is disclosed. This pump is rather elaborate with tubing since it is disposed in the back of the shoe. Again, the release valve must be separately depressed.

In U.S. Pat. No. 5,987,779 to Litchfield et al., another athletic shoe is disclosed having an inflatable tongue bladder. The pump disclosed also includes a release valve which must be enabled to release air.

There is a need for an athletic shoe having an inflatable tongue bladder which can be quickly and easily inflated or deflated.

SUMMARY OF THE INVENTION

It is an object of this invention to provide an athletic shoe having an inflatable tongue bladder that can quickly be inflated and deflated to conform to the contour of the wearer's foot.

It is a further object of this invention to provide such a shoe which does not require independent activation of a release valve.

These and other objects are preferably accomplished by providing an athletic shoe having an inflatable tongue which can be slightly deflated after lacing up or otherwise closing the shoe to conform to the user's foot or instep to provide a more comfortable fit of the shoe.

DESCRIPTION OF THE PREFERRED EMBODIMENTS

Figure 1:
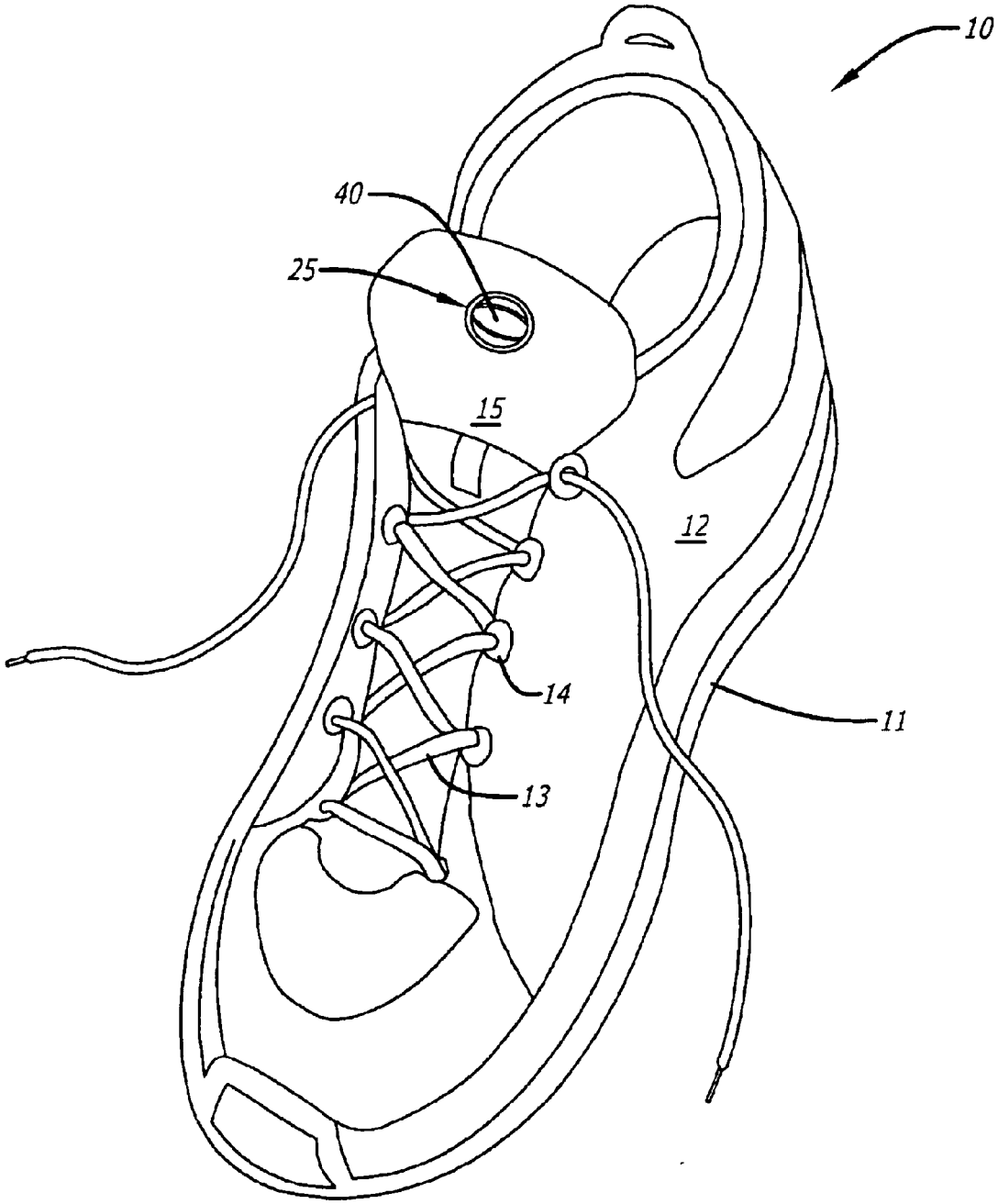
FIG. 1 is a perspective view of an athletic shoe with a tongue in accordance with the teachings of the invention.

Referring now to FIG. 1 of the drawing, an athletic shoe 10 is shown. Shoe 10 is a conventional shoe including a sole

11, an upper 12, laces 13 and eyelets 14. As particularly contemplated in the present invention, a tongue 15 is shown which is adapted to be sewn or otherwise secured into the normal position of a tongue in a shoe, as also shown in FIG. 2.

Figure 3:
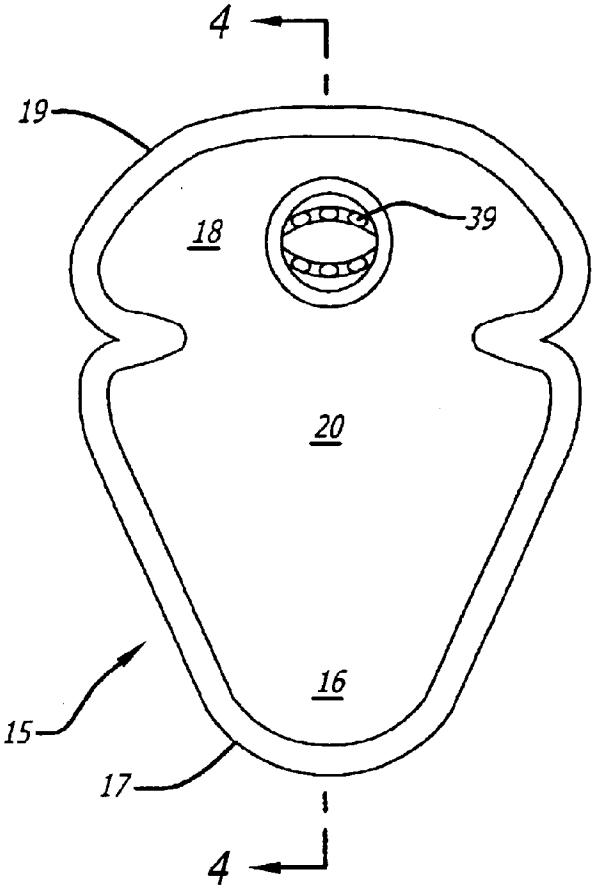
FIG. 3 is a plan view of the tongue alone of FIGS. 1 and 2 removed from the shoe.

Tongue 15 is shown removed from shoe 10 in FIG. 3. Tongue 15 is generally triangularly shaped but rounded at both ends. Thus, tongue 15 includes a first tapered narrow end 16, rounded at 17, and a second enlarged end 18, rounded at 19, interconnected by mid-portion 20.

Figure 2:
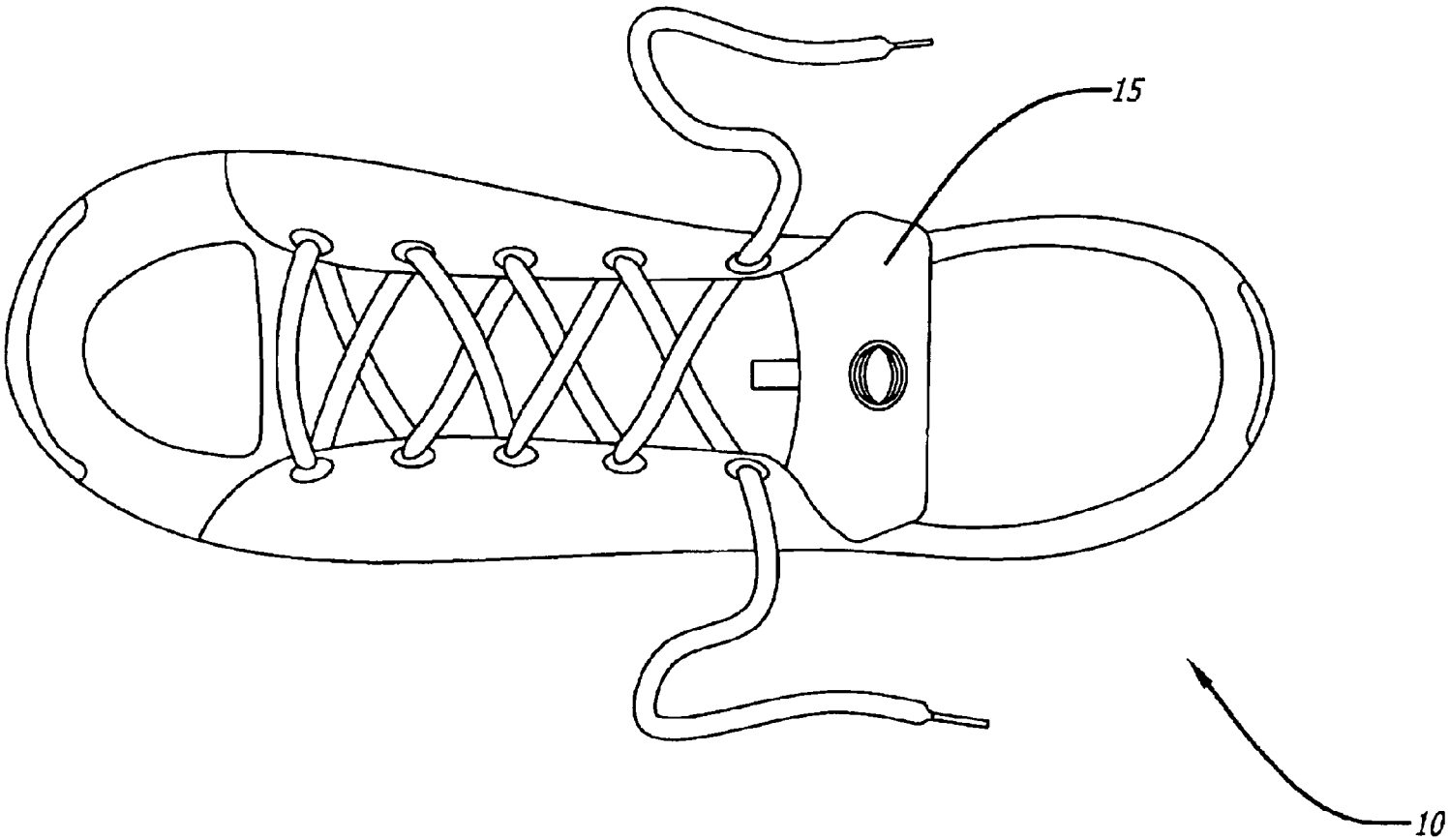
FIG. 2 is a top plan view of the shoe of FIG. 1.

End 16 is adapted to be sewn or otherwise secured internally of shoe 10 to provide a tongue for shoe 10 as seen in FIG. 2.

Figure 4:
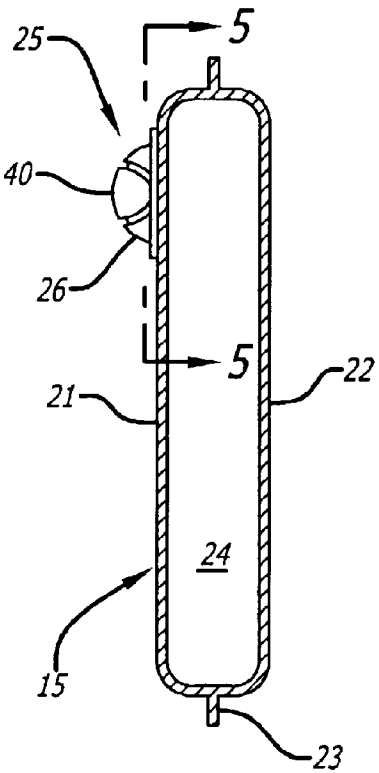
FIG. 4 is a view of the tongue of FIG. 3 taken along line 4—4 thereof.

As seen in FIG. 4, tongue 15 may be comprised of mating pieces of material, such as a first upper layer 21 of material stitched or otherwise secured to a second lower layer 22 of material along peripheral flange 23.

Any suitable material may be used for layers 21, 22. For example, a leather or woven material may be used or a combination thereof.

The interior of tongue 15 is filled with a sponge foam layer 24, such as urethane, or any suitable resilient material capable of allowing fluid to pass therethrough. One example is an open-cell or reticulated foam having 10 to 55 pores per inch. One such material is available from United Foam Plastics of Georgetown, Mass.

Thus, the layers 21 and 22, with foam layer 24, are attached at the edges along flange 23, forming a bladder.

Again as particularly contemplated in the present invention, a one-way valve 25 is provided having a raised or domed outer portion 26, which may have indicia 40 thereon (see FIG. 1), such as raised or embossed lettering or the like.

Figure 5:
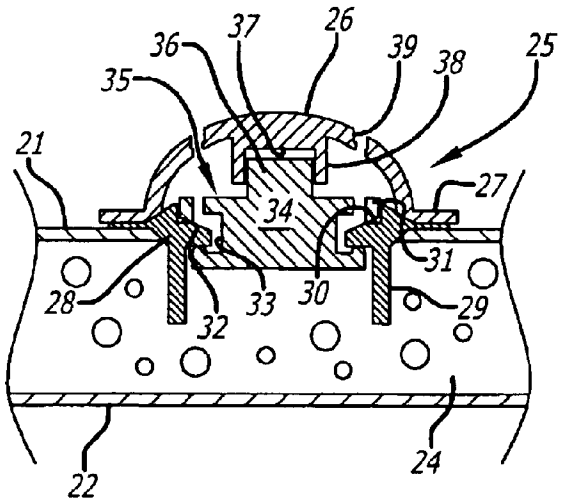
FIG. 5 is a view of the tongue of FIG. 4 taken along line 5—5 thereof.

Valve 25 is shown in detail in FIG. 5 and is comprised of outer domed portion 26 having a peripheral flange 27 secured to an inner valve portion 28, in any suitable manner, having an integral annular circular portion 29. Inner valve portion 28 is secured to layer 21 in any suitable manner and has a notched area 30 on its upper surface receiving therein a ring or washer 31. As seen, inner valve portion 28 has an inwardly extending flange portion 32 disposed in an annular notch 33 formed in the main body portion 34 of valve element 35. Valve element 35, as will be discussed, is a movable element within valve 25. The upper portion of valve element 35 has a protuberance 36 extending into a cavity 37 formed on the undersurface of domed portion 26 defined by a downwardly extending annular skirt 38.

As seen in FIG. 3, a plurality of spaced air holes 39 are provided through domed portion 26 communicating the exterior thereof with the interior of valve 25.

Figure 6:
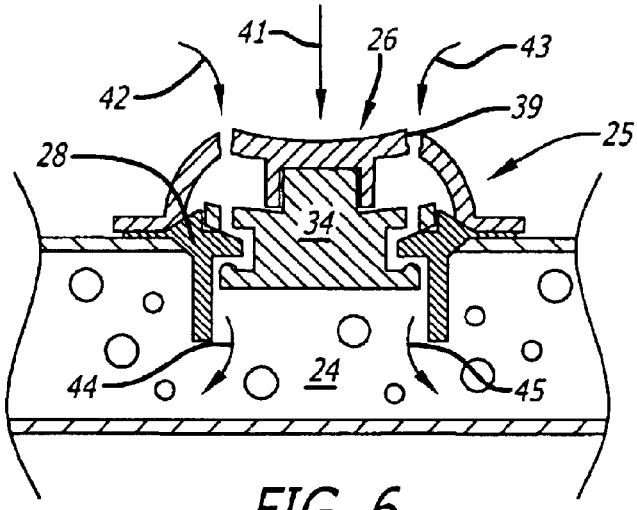
FIGS. 6 to 8 are cross-sectional views of the valve and tongue bladder of the shoe of FIGS. 1 to 4 illustrating actuation of the valve and the effect on the interior of the tongue bladder.
Figure 7:
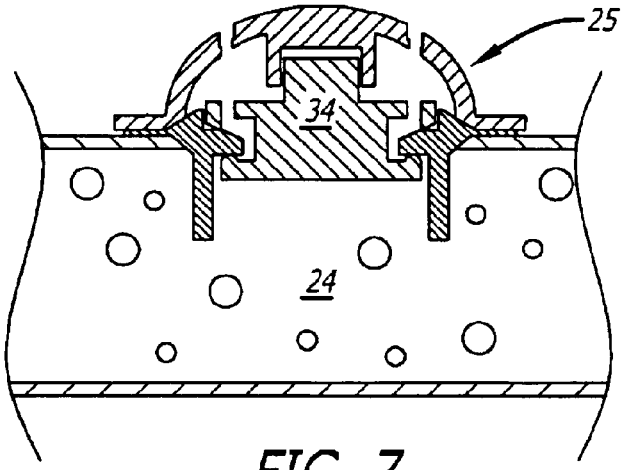

In operation, the normal deflated state of bladder 15 is shown in FIG. 5. As seen in FIG. 6, pressing down on valve portion 26 in the direction of arrow 41, allows air to enter through air holes 39, as indicated by arrows 42, 43, down between the valve portions 28 and 34 into the interior 24 of the bladder as indicated by arrows 44, 45. This introduces air into the tongue 15 (FIG. 2) and can be accomplished either on or off the user's foot. FIG. 7 illustrates the fully inflated position. The shoe 10 may then be put on the user's foot and laced up. The laces are tightened. Of course, rather than laces, other closing mechanisms may be used, such as straps having Velcro or buckle attachments, as is know to those skilled in the art. The terms inflated and deflated are relative terms, inflated meaning that there is more air in the bladder than when it is deflated. Therefore, an "inflated" bladder may be holding less air than it is capable of holding, but this same bladder in a "deflated" state would be holding relatively less air than in its "inflated" state.

Figure 8:
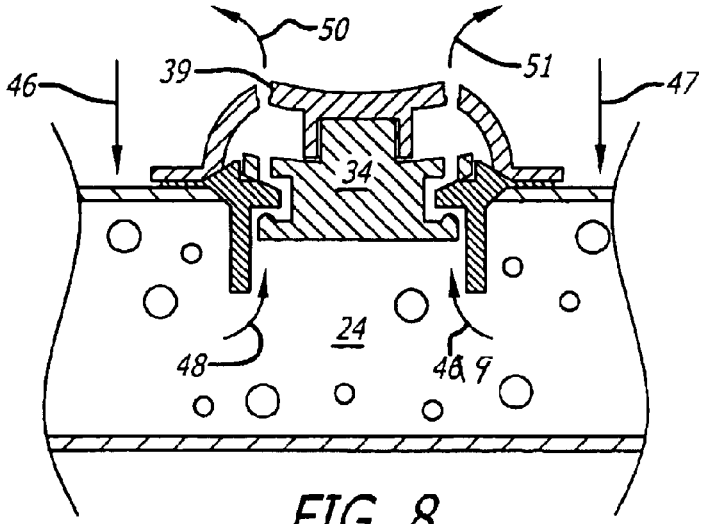

As seen in FIG. 8, squeezing or pushing down on tongue 15, as seen by arrows 46, 47, allows air to exit from interior 34, via arrows 48, 49, out of openings 39 as indicated by arrows 50, 51. The interior 24 is deflated sufficiently to allow tongue 15 to conform to the user's foot or instep and the lacing over tongue 15 provides cushioning and comfort to the foot of the wearer. This provides a more comfortable fit and conforms the shoe to the wearer's foot.

It can be seen that there is disclosed an athletic shoe comprising a tongue in the form of, or including, a wedge of open-cell foam inside a sealed plastic bladder. A preferred location for the bladder is between the laces, or other closure mechanism, of the shoe and the foot. The foam has a memory, and seeks to maintain an expanded shape. A sealable valve including a one-way diaphragm allows air to move in and out of the bladder. In one method of operation, the valve is opened manually and the bladder is allowed to expand prior to lacing of the shoe. The shoe is then laced up, or otherwise closed if straps or other closing mechanisms are used, placing pressure on the bladder. The valve may then be opened allowing air to exit the bladder conforming the tongue and bladder to the foot of the wearer of the shoe. Alternatively, the bladder can be squeezed and air pushed out past the diaphragm. The valve then self-seals, and holds the bladder in this relatively deflated state. The shoe is then laced up, or closed. The valve is then opened manually, and air is pulled in as the foam expands. The expansion is limited by the space between the foot and the shoe. The result is a customized amount of cushioning because only enough air is present in the bladder to fill the gap between the foot and the shoe.

Although a particular embodiment has been disclosed, variations thereof may occur to an artisan and the scope of the invention should only be limited by the scope of the appended claims.

What is claimed is:

1. An athletic shoe comprising:

a) a sole;

b) an upper having a tongue and lacing means on said upper for lacing the shoe, said upper being attached to said sole; and c) said tongue comprising a bladder of an open celled foam material on the interior thereof sealed from the atmosphere except for a valve on said tongue communicating the interior of said bladder with the atmosphere, said valve being adapted to selectively draw air from the atmosphere into said interior when opened to allow expansion of the foam material in said interior, then release air from said interior to the atmosphere when said bladder is squeezed releasing air from said interior out of said valve, whereby said tongue may be inflated and said lacing means laced up against said tongue pressing said tongue against the foot of the wearer of the shoe, then said tongue may be slightly deflated to conform said tongue to the foot of the wearer of the shoe.

2. The shoe of claim 1 wherein said bladder has an exterior layer comprised of upper and lower portions of flexible material sewn together about their periphery.

3. The shoe of claim 2 wherein said interior is of foamed urethane material.

4. The shoe of claim 1 wherein said interior is of foamed urethane material.

5. The shoe of claim 1 wherein said valve includes a first outer domed portion on the exterior of said tongue, a plurality of spaced air holes through said domed portion fluidly communicating the interior of said tongue with the atmosphere.

6. The shoe of claim 5 wherein said valve includes said first outer domed portion having a downwardly extending cylindrical skirt portion, a first valve element having an upper protuberance received within said skirt portion and reciprocal therein and an integral lower portion, a second valve element secured to both said domed portion and said exterior of said tongue.

7. The shoe of claim 6 wherein said second valve element includes a downwardly extending cylindrical skirt portion extending into the interior of said bladder, said second valve element having an annular flange surrounding an opening through which the lower portion of said first valve element extends.

8. The shoe of claim 7 wherein the annular flange of said second valve element extends into an annular notch in the lower portion of said first valve element and is movable up and down therein.

9. The shoe of claim 8 wherein said second valve element has an annular notch therein on the upper surface thereof inwardly of said place of securement of said second valve element to the exterior of said tongue.

10. The shoe of claim 9 including an annular ring disposed in said notch spaced from said second valve element.

11. An athletic shoe comprising:

a) a sole;

b) an upper having a tongue and laces on said upper for lacing the shoe, said upper being attached to said sole; and c) said tongue comprising a bladder of an open celled foam material on the interior thereof sealed from the atmosphere except for a valve on said tongue communicating the interior of said bladder with the atmosphere, said valve being adapted to selectively draw air from the atmosphere into said interior when opened to expand the foam material in said interior, then release air from said interior to the atmosphere when said bladder is squeezed releasing air from said interior out of said valve, whereby said tongue may be inflated and said laces laced up against said tongue pressing said tongue against the foot of the wearer of the shoe, then said tongue may be slightly deflated by opening the valve to conform said tongue to the foot of the wearer of the shoe.

12. An athletic shoe comprising:

a) a sole;

b) an upper having a tongue and laces on said upper for lacing rho shoe, said upper being attached to said sole; and c) said tongue comprising a bladder of an open celled foam material on the interior thereof sealed from the atmosphere except for a valve on said tongue communicating the interior of said bladder with the atmosphere, said valve being adapted to selectively draw air from the atmosphere into said interior when opened to expand the foam material in said interior, then release air from said interior to the atmosphere when said bladder is squeezed releasing air from said interior out of said valve, whereby said tongue may be partially deflated and then said laces laced up against said tongue pressing said tongue against the foot of the wearer of the shoe, then said tongue may be slightly inflated by opening the valve allowing air to enter to conform said tongue to the foot of the wearer of the shoe.

13. An athletic shoe comprising:

a) a sole;

b) an upper having a tongue and a closing mechanism on said upper for closing the shoe, said upper being attached to said sole; and c) said tongue comprising a bladder of an open celled foam material on the interior thereof sealed from the atmosphere except for a valve on said tongue communicating the interior of said bladder with the atmosphere, said valve being adapted to selectively draw air from the atmosphere into said interior when opened to expand the foam material in said interior, then release air from said interior to the atmosphere when said bladder is squeezed releasing air from said interior our of said valve, whereby said tongue may be inflated and said closing mechanism closed against said tongue pressing said tongue against the foot of the wearer of the shoe, then said tongue may be slightly deflated by opening the valve to conform said tongue to the foot of the wearer of the shoe.

14. An athletic shoe comprising:

a) a sole;

b) an upper having a tongue and a closing mechanism on said upper for closing the shoe, said upper being attached to said sole; and c) said tongue comprising a bladder of an open celled foam material on the interior thereof sealed from the atmosphere except for a valve on said tongue communicating the interior of said bladder with the atmosphere, said valve being adapted to selectively draw air from the atmosphere into said interior when opened to expand the foam material in said interior, then release air from said interior to the atmosphere when said bladder is squeezed releasing air from said interior out of said valve, whereby said tongue may be partially deflated and then said closing mechanism closed against said tongue pressing said tongue against the foot of the wearer of the shoe, then said tongue may be slightly inflated by opening the valve allowing air to enter to conform said tongue to the foot of the wearer of the shoe.

15. A shoe tongue comprising:

a) a bladder; and b) a valve located in the bladder, the bladder having a bladder interior portion and a bladder exterior portion, the bladder exterior portion surrounding the bladder interior portion and sealing the bladder interior portion from atmosphere, and the valve having a valve external portion and a valve internal portion, the valve external portion located on the bladder exterior portion and the valve internal portion located in the bladder interior portion, the valve connecting the bladder with the atmosphere, the valve having an intake operating mode and a release operating mode, wherein in the intake operating mode, the valve selectively draws air from atmosphere into said bladder interior portion through the valve interior portion, upon application of a pressure to the valve external portion, and in the release operating mode, the valve releases air from said bladder interior portion to the atmosphere through the valve external portion, upon application of a pressure to the bladder exterior portion.

* * * * *